US008678213B2

(12) United States Patent
Boukobza

(10) Patent No.: US 8,678,213 B2
(45) Date of Patent: Mar. 25, 2014

(54) CONTAINER IN WHICH THE BASE IS PROVIDED WITH A DOUBLE-SEATED FLEXIBLE ARCH

(75) Inventor: Michel Boukobza, Octeville sur Mer (FR)

(73) Assignee: Sidel Participations, Octeville sur Me (FR)

( * ) Notice: Subject to any disclaimer, the term of this patent is extended or adjusted under 35 U.S.C. 154(b) by 180 days.

(21) Appl. No.: 13/148,201

(22) PCT Filed: Feb. 8, 2010

(86) PCT No.: PCT/FR2010/000088
§ 371 (c)(1), (2), (4) Date: Oct. 13, 2011

(87) PCT Pub. No.: WO2010/092246
PCT Pub. Date: Aug. 19, 2010

(65) Prior Publication Data
US 2012/0037645 A1 Feb. 16, 2012

(30) Foreign Application Priority Data
Feb. 12, 2009 (FR) ..... 09 00623

(51) Int. Cl.
*B65D 1/04* (2006.01)

(52) U.S. Cl.
USPC ..... 215/376; 215/370; 220/609

(58) Field of Classification Search
USPC ..... 215/376, 370; 220/609, 629, 628, 636, 220/623, 675
See application file for complete search history.

(56) References Cited

U.S. PATENT DOCUMENTS 3,409,167 A * 11/1968 Blanchard ..... 220/609
2007/0051073 A1 3/2007 Kelley et al.
2008/0298938 A1 12/2008 Melrose

FOREIGN PATENT DOCUMENTS

FR 2 503 665 A1 10/1982
WO 2006/068511 A1 6/2006

* cited by examiner

*Primary Examiner* — Stephen Castellano
(74) *Attorney, Agent, or Firm* — Sughrue Mion, PLLC

(57) ABSTRACT

Container of plastic material, comprising a body and a bottom extending from a lower end of the container, the body having a diameter C at the junction with the bottom, in which container the bottom has:

an annular outer seat having a predetermined transverse dimension B such that:

$$0.95 \leq \frac{B}{C} \leq 1$$

a deformable arch that extends into the interior of the annular outer seat and which, in a deployed position, extends to the exterior of the container and defines an annular inner seat having a predetermined transverse dimension A such that:

$$1.2 \leq \frac{B}{A} \leq 1.4$$

10 Claims, 2 Drawing Sheets

1
2
3
4
5
6
7
8
9
10
11
12
13
14
15
X
A
B
C
8,9
13,14

1
2
3
4
5
6
7
8,9
10
11
12
13,14
15
X
A
B
C
h

CONTAINER IN WHICH THE BASE IS PROVIDED WITH A DOUBLE-SEATED FLEXIBLE ARCH

CROSS REFERENCE TO RELATED APPLICATIONS

This application is a National Stage of International Application No. PCT/FR2010/000088 filed on Feb. 8, 2010, which claims priority from French patent application Ser. No. 09/00623, filed on Feb. 12, 2009, the contents of all of which are incorporated herein by reference in their entirety.

The invention relates to the manufacture of containers, such as bottles or jars, obtained by blowing or stretch blowing of preforms made of thermoplastic material.

Conventional stretch blowing induces a bi-orientation of the material (axial and radial) which gives the final container good structural rigidity. However, the bi-orientation induces in the material residual stresses which, during hot filling (particularly with a liquid at a temperature above the glass transition temperature of the material) are released, causing a deformation of the container that could make it unsuitable for sale.

To decrease the deformation of the container during hot filling, it is known to complete the stretch blowing by a thermal treatment called heat set, a treatment by which the just-formed container is kept in contact with the heated wall of the mold at a temperature of between 120° C. and 250° C. for a predetermined time (generally a few seconds).

However, the heat set method only resolves part of the problems of deformation of the container related to hot filling. In effect, during cooling the liquid and the air above it inside the capped container undergo a decrease in volume that tends to cause the container to retract.

Several solutions have been considered for decreasing the visible effects of such retraction. These solutions generally concern the shape of the container.

Thus, it has been proposed to provide the body of the container with deformable panels which, during the cooling of the liquid, bend under the effect of the retraction. This method has proved its value, but it is not entirely satisfactory because gripping the container becomes hazardous due to the flexible nature of the body.

It has therefore been proposed to provide the bottom of the container with the ability to be deformed (or to be forcibly deformed) in order to adapt to the retraction of the liquid as it cools. Thus, the document WO 2006/068511 proposes a container, the bottom of which can adopt two positions, i.e. one deployed position in which the bottom extends outward from the container, and a retracted position in which the bottom extends toward the interior of the container. The deployed position is adopted by the bottom prior to the filling of the container, while the retracted position is adopted after filling, to accompany the retraction of the liquid due to its cooling. The changeover from the deployed position to the retracted position can be forced by means of a tool used to apply pressure to the bottom toward the interior of the container (see FIGS. 12*a* to 12*d*). As a result of this arrangement, it is possible to rigidify the body, thus benefiting the gripping of the container.

However, the manufacture of this type of container is problematic because of difficulties in handling. In effect, the containers must be transferred, with the bottom deployed, from the blowing station to the filling station, then from the filling station to the station where the bottom is reversed. The containers can be transported by means of gripper arms beneath the neck, from which the containers are suspended.

This handling involves limitations due to the necessity of synchronizing the transfer devices. Moreover, it does not allow the containers to be stored in buffer zones to compensate for starts and stops in the production line. This is the reason transport is preferable by conveyor belt on which the containers rest on their bottom. However, as a result of the small diameter of the seat due to the conicity of the projecting bottom, the containers are unstable and the risk of tipping over (and thus clogging the conveyor) is high.

In order to limit the risk of the containers tipping over during transport, some manufacturers use stabilization devices having cups into which the projecting bottoms of the containers are received; see document US 2007/0051073 (in particular see FIG. 5C).

Although at first appearance this solution seems to be of value, it is necessary for the containers to be correctly positioned in their cups, or the risk of tipping over is increased. This handling, which requires great precision in positioning the containers in the stabilization devices, consequently involves limitations close to those caused by the use of gripper transfer devices which, as we have already explained, appear questionable in this application.

The invention therefore seeks to offer a solution making it possible to improve the security of the transport of containers having projecting bottoms.

To that end, the invention proposes a container of plastic material, comprising a body and a bottom extending from a lower end of the container, the body having a diameter C at the junction with the bottom, in which container the bottom has:

an annular outer seat having a predetermined transverse dimension B such that:

$$0.95 \leq \frac{B}{C} \leq 1$$

a deformable arch that extends into the interior of the annular outer seat and which, in a deployed position, extends to the exterior of the container and defines an annular inner seat having a predetermined transverse dimension A such that:

$$1.2 \leq \frac{B}{A} \leq 1.4$$

A container with these dimensions has an increased stability not only when it rests on its outer seat (after filling and the arch returns as the liquid cools) but also when it rests on its inner seat (prior to filling), which, compared to known containers, is offset toward the periphery of the bottom.

The ratio $$\frac{B}{C}$$

is for example, 0.98.

According to a first embodiment, the ratio $$\frac{B}{A}$$

is 1.32.

According to another embodiment, the ratio $$\frac{B}{A}$$

is 1.23.

Moreover, in the deployed position of the arch, the container preferably has an axial offset h between the outer seat and the inner seat such that:

$$0.01 \leq \frac{h}{C} \leq 0.1$$

According to a first embodiment, the ratio $$\frac{h}{C}$$

is 0.08.

According to a second embodiment, the ratio $$\frac{h}{C}$$

is 0.014.

Furthermore, at the junction between the body and the bottom, the container preferably has a fillet with a radius r such that:

$$\frac{r}{C} \leq \frac{1}{100}$$

The tangent to the body, in the vicinity of its junction with the bottom, preferably forms an angle of less than 30° with the principal axis of the container.

In one particular embodiment, the body in the vicinity of its junction with the bottom is substantially cylindrical, the angle mentioned above then being nearly zero.

Other objects and advantages of the invention will be seen from the following description with reference to the appended drawings in which.

Figures 1, 2, 3:
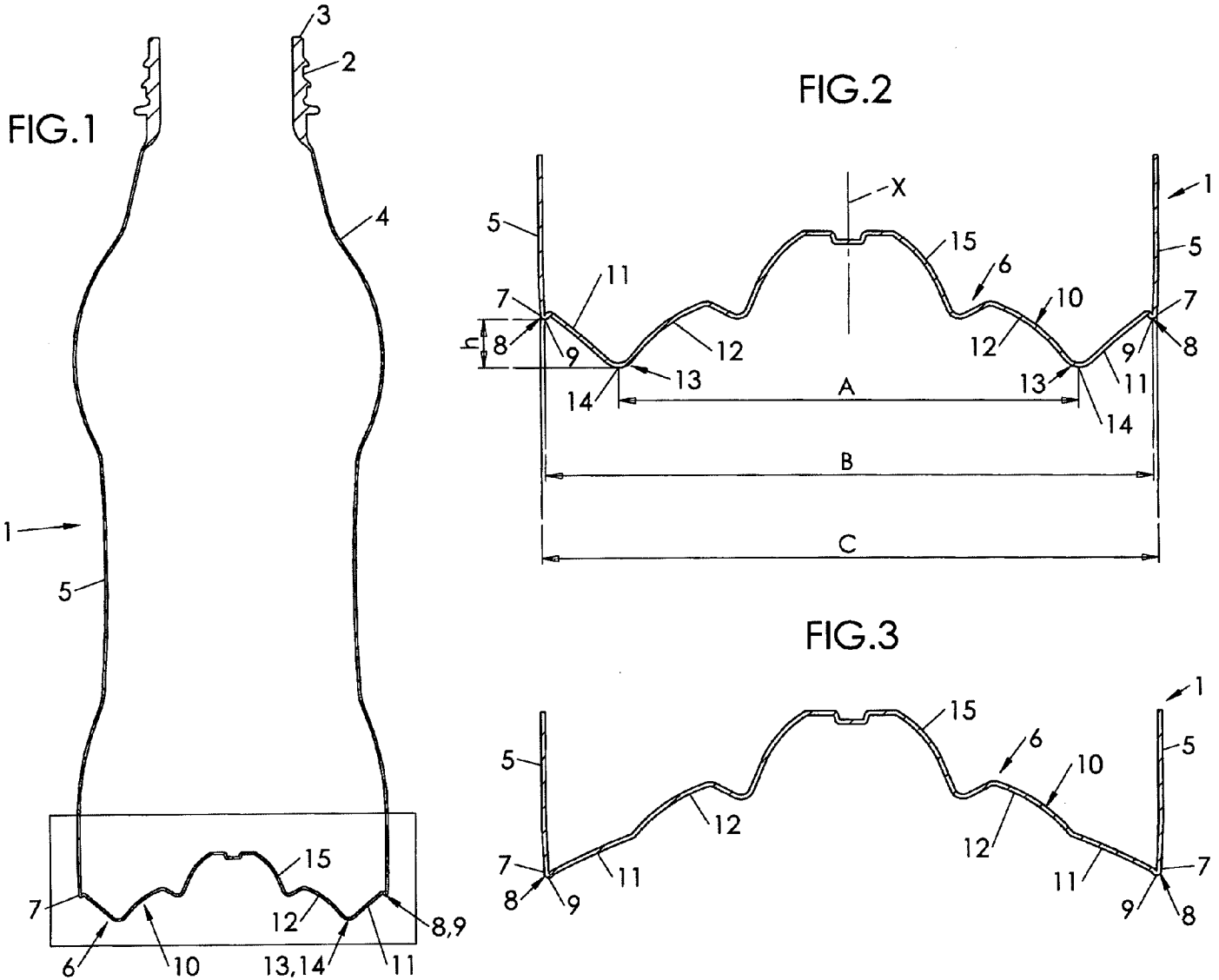
FIG. 1 is a cross-sectional elevation view showing a container according to a first embodiment.
FIG. 2 is a detailed view showing the bottom of the container of FIG. 1, in a deployed position.
FIG. 3 is a view similar to FIG. 2, showing the bottom in a retracted position.

Represented in FIGS. 1 and 3 are two embodiments of a container 1—in this instance a wide neck bottle—produced by stretch blowing from a preform of thermoplastic material such as PET (polyethylene terephthalate). This container is preferably of the HR type and is manufactured by stretch blowing in a mold the wall of which is heated in such a way as to increase the rate of crystallinity of the material by heat transmission.

This container 1 comprises, at an upper end, a threaded neck 2 with a wide mouth 3. In the extension of the neck 2, the container 1 comprises in its upper part a shoulder 4 extended by a lateral wall or body 5, which overall is symmetrical in revolution around a principal axis X of the container 1.

The container 1 further comprises a bottom 6 which extends at a lower end of the container 1 in the extension of the body 5.

Figures 4, 5, 6:
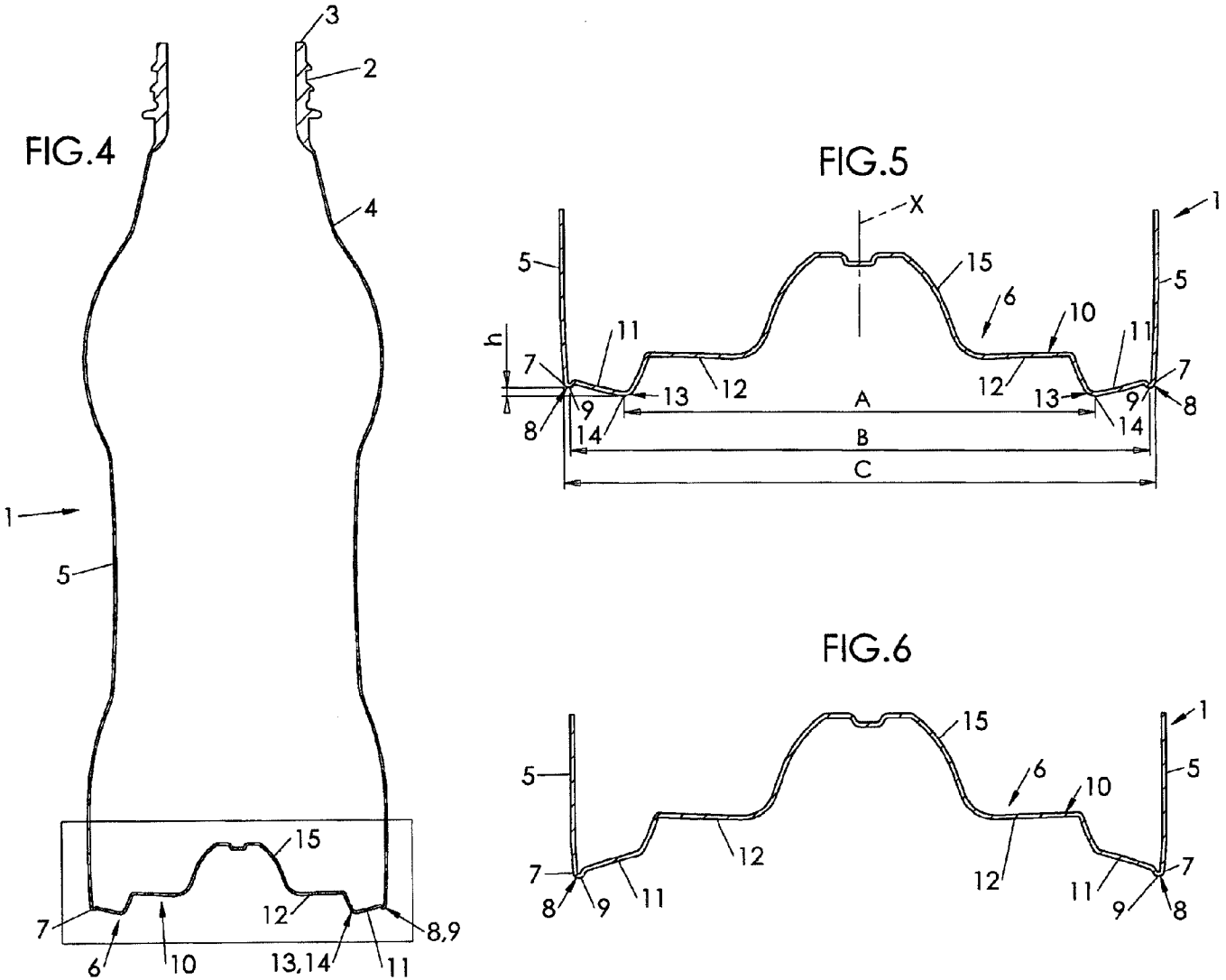
FIG. 4 is a cross-sectional elevation view showing a container according to a second embodiment.
FIG. 5 is a detailed view showing the bottom of the container of FIG. 4, in a deployed position.
FIG. 6 is a view similar to FIG. 5, showing the bottom in a retracted position.

As can be seen in FIGS. 2 and 5, the body 5 in a lower part of the container, is substantially cylindrical and extends downward to a lower end 7 where it joins the bottom 6. The bottom 6 comprises, in the immediate the vicinity of said junction 7, an annular bead 8 forming, in a particular configuration described below, a circular outer seat 9 by which the container 1 can rest flat on a flat surface such as a table (in common use) or the upper surface of a conveyor belt (to allow its handling on the production line).

The bottom 6 further comprises an arch 10 which extends from the outer seat 9 to the interior thereof, i.e. toward the axis X of the container 1.

The arch 10 is deformable and can adopt two positions, to wit:

- A deployed position, represented in FIGS. 2 and 5, in which the arch 10 extends at least in part projecting with respect to the outer seat 9 toward the exterior of the container 1 (i.e., opposite the neck 2),
- A retracted position, represented in FIGS. 3 and 6, in which the arch 10 projects with respect to the outer seat 9 toward the interior of the container 1 (i.e. toward the neck).

The arch 10 comprises an annular membrane 11 which extends from the bead 8 in the extension thereof toward the axis X and projects toward the exterior of the container 1. In the deployed position of the arch 10, the membrane 11 is in the shape of a truncated cone of revolution around the axis X.

The arch 10 further comprises an annular median part 12 that is cup-shaped, the concavity turned toward the exterior of the container 1 in the extension of the membrane 11 toward the axis X and projects toward the interior of the container 1.

Thus, the membrane 11 and the median part 12 together define, at their junction, an annular uppermost portion 13 which, in the deployed position of the arch 10, constitutes the lowest zone of the container 1 (held vertically with its neck 2 open upwards) and in this way forms an inner seat 14, by which the container can be placed flat on a flat surface such as a table or the upper surface of a conveyor belt.

Finally, the arch 10 comprises, in the extension of the median part 12, a central pin 15 which extends around the axis X projecting toward the interior of the container 1.

Note should be made that:

- A is the diameter of the inner seat 14;
- B is the diameter of the outer seat 9;
- C is the outside diameter of the bottom 6, measured at the junction 7 with the body 5;
- h is the axial extension of the arch 10, equal to the axial offset between the inner seat 14 and the outer seat 9, in the deployed position of the arch 10.

Although the term "diameter" commonly designates the transverse dimension of an object having a symmetry of revolution around an axis (which is the case here), it is generalized in this context for containers that would not have symmetry of revolution, and the transverse cross-sectional profile would for example be square, oval, etc. In this case, the term "diameter" designates more generally the transverse dimension (width) measured in any plane of symmetry—or in any plane containing the axis X—of the container 1.

The inner seat 14 and the outer seat 9 are dimensioned in order to achieve a high degree of stability of the container 1 placed flat, both in the deployed position of the arch 10 (in which position the container 1 rests on the inner seat 14) as well as in the retracted position (in which the container 1 rests on the outer seat 9).

To that end, the diameters A, B and C are correlated in accordance with the following relations:

$$0.95 \leq \frac{B}{C} \leq 1 \quad (1)$$

and $$1.2 \leq \frac{B}{A} \leq 1.4 \quad (2)$$

The relation (1) shows that the outer seat 9 is offset to the maximum toward the periphery of the bottom 6, at its junction 7 with the body 5. At this junction 7, which corresponds to the lower end of the body 5, the tangent to the body 5 forms with the axis X of the container 1 a small angle, less than 30° (in the illustrated embodiments, the body 5 has a shape that is cylindrical in revolution, so that this angle is substantially zero). The stability of the container 1 in the retracted position of the arch 1 [sic] is thus increased. In the illustrated embodiments, the ratio $$\frac{B}{C}$$

is approximately 0.98.

The relation (2) shows that the ratio between the diameters B and A is quite close to 1, but a difference between these two diameters is inevitable due to the presence of the flexible membrane 11. The range recommended by the relation (2) offers a good compromise between two a priori contradictory objectives, i.e. a maximization of the diameter A (i.e. a minimization of the ratio $$\frac{B}{A}),$$

benefiting the stability of the container 1 in the deployed position of the arch 1 [sic], and a maximization of the radial extension of the membrane 11 (i.e. a maximization of the ratio $$\frac{B}{A})$$

to allow a non-destructive return of the arch 10 to its retracted position, at least without said return causing the appearance of cracks or incipient cracks. In the first embodiment, illustrated in FIGS. 1 to 3, the ratio $$\frac{B}{A}$$

Is 1.32; in the second embodiment, illustrated in FIGS. 4 to 6, the ratio $$\frac{B}{A}$$

Is 1.23.

Furthermore, the relations (1) and (2) can be combined to express a direct correlation between the diameters A and C:

$$0.65 \leq \frac{A}{C} \leq 0.85 \quad (3)$$

This relation expresses in a different way the compromise mentioned above, the value of the diameter A of the inner seat 14 being also as close as possible to the value of the diameter C of the outer seat 9 in order to maximize the width of the seat 14 in the deployed position of the arch 10, while providing, between the periphery of the bottom 6 (diameter C) and the inner seat 14 (diameter C), sufficient space to accommodate there the outer seat 9 (diameter B), offset to the maximum toward the periphery of the bottom 6 (as expressed in the relation (1)), and the flexible membrane 11 inserted between the two seats 9 and 14.

In the first embodiment, illustrated in FIGS. 1 to 3, the ratio $$\frac{A}{C}$$

Is 0.74; in the second embodiment, illustrated in FIGS. 4 to 6, the ratio $$\frac{A}{C}$$

Is 0.80.

Furthermore, the value of the axial extension h of the arch 10 in the deployed position should be high enough to enable an appropriate decrease in the volume of the container 1 during the return of the arch 10, corresponding to the cumulative total of the decreases in volume—due to cooling—of the liquid and the air present in the head space (defined as being between the liquid and the cap closing the container). On the contrary, however, two requirements tend to minimize the axial extension h of the arch 10 in the deployed position: on the one hand, the need, for purposes of stability, not to excessively increase the overall height of the container 1, and on the other hand the need to facilitate the return of the arch 10. The following relation, which proposes to correlate the extension h with the diameter C of the bottom 6 while maintaining the ratio of these two dimensions within a predetermined range, offers a good compromise between these contradictory requirements:

$$0.01 \leq \frac{h}{C} \leq 0.1 \quad (4)$$

In other words, the value of the axial extension h falls between 1/100 and 1/10 of the value of the diameter C of the bottom 6. In the first embodiment, illustrated in FIGS. 1 to 3, the ratio $$\frac{h}{C}$$

is 0.08. This embodiment, in which the ratio $$\frac{h}{C}$$

Is close to the upper limit of the recommended range, corresponds to a case in which the low pressure inside the container that accompanies the cooling of the liquid can prove to be insufficient to cause the return of the arch 10. The return of the arch 10 can then be forced by means of a tool by which an upward force is exerted on the arch, for example at the pin 15. In the second embodiment, illustrated in FIGS. 4 to 6, the ratio $$\frac{h}{C}$$

is 0.014. This second embodiment, in which the ratio $$\frac{h}{C}$$

is close to the lower limit of the recommended range, corresponds to a case in which the low pressure inside the container that accompanies the cooling of the liquid is sufficient to cause the return of the arch 10 without the need to force this return by means of a tool.

Furthermore, as can be seen in the figures, and more specifically in FIGS. 2, 3, 5 and 6, the fillet between the body 5 of the container 1 and the bottom 6, which forms the outer part of the bead 8 defining the outer seat 9, has a radius r of slight curvature with respect to the diameter C, compared to an ordinary container.

More specifically, the dimensions r and C preferably verify the following relation:

$$\frac{r}{C} \leq \frac{1}{100} \tag{5}$$

The rigidity of the outer seat 9 is thereby increased. In practice, for a diameter C of the bottom of 100 mm (for example for a bottle with a capacity of 2 L) the radius r of the fillet is preferably less than 1 mm. For a diameter C of 60 mm (for example for a bottle with capacity of 0.5 L), the radius r of the fillet is less than 0.6 mm, and is for example 0.5 mm.

In order to manufacture a container 1 that meets the dimensional requirements defined by the relation (5), preferably a technique will be used of stretch blowing in a mold having a lateral wall defining a lower opening and a mold bottom that is movable with respect to the wall of the mold between:

a lower position, adopted at the beginning of blowing, in which the mold bottom is separated downward from the opening, and an upper position, adopted at the end of blowing, in which the mold bottom blocks the opening and pushes upward on the material of the bottom 6 of the container 1.

This technique, called boxing, makes it possible to increase the rate of stretching of the container 1, to the benefit of its mechanical rigidity. By using a mold bottom the diameter of which is substantially equal to the diameter of the sidewall at the lower opening, the radius r of the fillet between the body 5 and the bottom 6 of the container 1 can be reduced to a value that meets the recommendation of the relation (5).

The invention claimed is:

1. Container of plastic material, comprising a body and a bottom extending from a lower end of the container, the body having a diameter C at the junction with the bottom, in which container the bottom has:

an annular outer seat having a predetermined transverse dimension B such that:

$$0.95 \leq \frac{B}{C} \leq 1$$

a deformable arch that extends into the interior of the annular outer seat and which, in a deployed position, extends to the exterior of the container and defines an annular inner seat having a predetermined transverse dimension A such that:

$$1.2 \leq \frac{B}{A} \leq 1.4.$$

2. Container according to claim 1, wherein the ratio $$\frac{B}{C}$$

is 0.98.

3. Container according to claim 1, wherein the ratio $$\frac{B}{A}$$

is 1.32.

4. Container according to claim 1, wherein the ratio $$\frac{B}{A}$$

is 1.23.

5. Container according to claim 1, which, when the arch is in the deployed position, has an axial offset h between the outer seat and the inner seat such that:

$$0.01 \leq \frac{h}{C} \leq 0.1.$$

6. Container according to claim 5, wherein the ratio $$\frac{h}{C}$$

is 0.08.

7. Container according to claim 5, wherein the ratio $$\frac{h}{C}$$

is 0.014.

8. Container according to claim 1, which has at a junction between the body and the bottom a fillet having a radius r such that:

$$\frac{r}{C} \leq \frac{1}{100}.$$

9. Container according to claim 1, wherein the tangent to the body in the vicinity of its junction with the bottom forms an angle of less than 30° with the longitudinal axis of the container.

10. Container according to claim 9, wherein the body, in the vicinity of its junction with the bottom, is substantially cylindrical.

* * * * *